United States Patent [19]

Forge

[11] 4,167,719

[45] Sep. 11, 1979

[54] VARIABLE RATIO TRANSFORMER

[75] Inventor: Charles O. Forge, Los Altos, Calif.

[73] Assignee: Boschert Associates, Sunnyvale, Calif.

[21] Appl. No.: 942,923

[22] Filed: Sep. 18, 1978

[51] Int. Cl.[2] ..... H01F 21/02

[52] U.S. Cl. ..... 336/77; 323/50; 336/79; 336/83; 336/120

[58] Field of Search ..... 323/50, 85; 336/73, 336/75, 77, 79, 83, 120, 135

[56] References Cited

U.S. PATENT DOCUMENTS 3,430,173 2/1969 Orlando ..... 336/79

4,031,496 6/1977 Fujiwara et al. ..... 336/135

*Primary Examiner*—Thomas J. Kozma

*Attorney, Agent, or Firm*—Linval B. Castle

[57] ABSTRACT

An adjustable output transformer using a pair of adjacent facing pot cores, the first of which carries both primary and secondary windings, the second having only a shorted winding around one leg. The shorted winding inhibits flux through its leg and the corresponding portion of the adjacent leg on the first core so that the secondary voltage may be varied by adjusting the relative rotational positions of the two cores and hence the amount of flux linking the secondary winding.

8 Claims, 18 Drawing Figures

VARIABLE RATIO TRANSFORMER

SUMMARY OF THE INVENTION

This invention relates to transformers and particularly to a novel transformer that may be adjusted to vary the flux linking the secondary winding and hence the effective turns ratio of the transformer.

Such variable output transformers have many uses in present day electronic equipment applications. For example, a variable transformer may be used to closely adjust the A.C. voltage to a power supply rectifier circuit to provide a precise predetermined D.C. voltage output of the supply. The variable transformer is also very important for use in multi-output regulated power supplies, such as the modern switching regulator supply in which one of the multi-output levels is monitored and compared against a standard so that the error signal therefrom may be used for regulating the primary circuit duty ratio. In such circuits, the accuracy of the remaining unmonitored outputs depends upon the accuracy of the power supply transformer turns ratio and, to a certain degree, to the D.C. resistance of the rectifying diodes and associated output conductors. As will be later described in detail, the variable output transformer of the invention may be used to accurately adjust the A.C. outputs of a multi-tapped power supply transformer so that all unmonitored D.C. output voltages from the supply are accurate, thereby obviating the need for a high precision and consequently a high cost power supply transformer with carefully calibrated partial turn secondary windings that hopefully produce the desired power supply D.C. output voltages.

Briefly described, the adjustable output transformer of the present invention applies a pair of commercially available conventional pot cores having a circular central section and a pair of semicircular legs. The primary winding encircles the central section of the first core and the secondary windings are wound on one or both legs of that first core. The second core contains only a short-circuited winding on one leg. When both cores are in contact and facing each other, the shorted winding on the second core inhibits flux flow through that leg and through the corresponding portion of the adjacent leg on the first core. Thus, the flux through the leg carrying the secondary winding, and hence the output voltage, can be accurately varied by adjusting the rotational positioning of the two cores.

DESCRIPTION OF THE DRAWINGS

In the drawings which illustrate a preferred embodiment of the invention.

DETAILED DESCRIPTION

Figure 1:
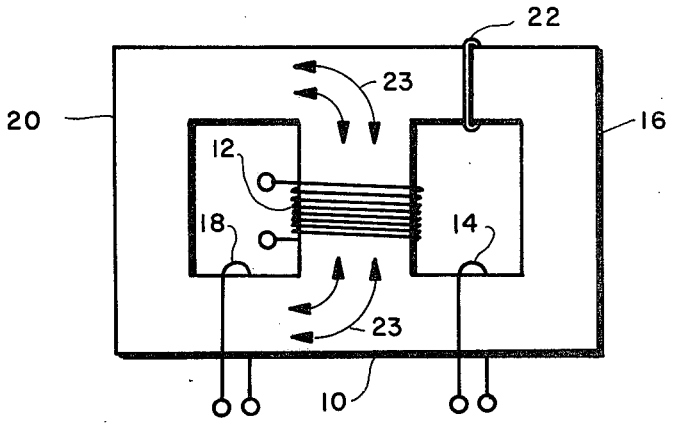
FIG. 1 is a schematic diagram of a typical shell-type transformer core that is presented to explain the principle of the invention.

FIG. 1 is a schematic diagram of a shell-type transformer core 10 containing a primary winding 12 on the center leg, a secondary winding 14 on the leg 16 and another secondary winding 18 on the leg 20. Also, encircling the leg 16 is a short-circuited winding 22. Without the short-circuit winding 22 and with equal loads connected to secondary windings 14 and 18, the flux pattern within the core 10 would be symmetrical and equal fluxes would link the two secondary windings 14 and 18. However, an unbalanced secondary load will cause an unbalanced flux pattern through the core legs and the greater amount of flux will link the secondary winding coupled to the smaller load. The effect of the short-circuited winding 22 is to place an infinitely high secondary load on that winding with the result that virtually all of the flux will be forced through leg 20 as indicated by the arrows 23.

Figure 3:
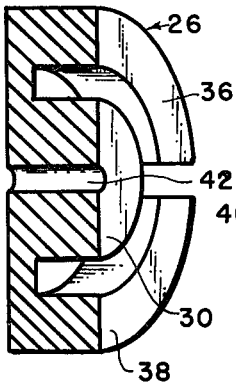
FIG. 3 is a perspective view illustrating a section of a pot core identical with that illustrated in FIG. 2.
Figure 2:
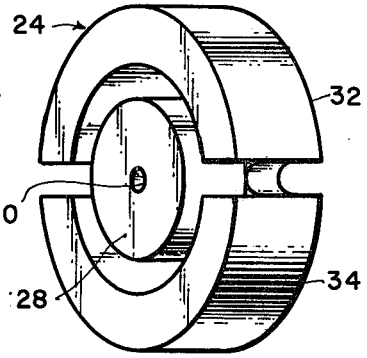
FIG. 2 is a perspective view illustrating a pot core such as used in the invention.

FIG. 2 is a perspective view illustrating a typical pot core that is commercially available from several ferrite core manufacturers, such as, for example, Stackpole Carbon Company of St. Marys, Pennsylvania, or Magnetics, Inc. of Butler, Pennsylvania, or FAIR-RITE CO. of Wallkill, New York. The pot core 24 of FIG. 2 is identical with the pot core 26 shown in the sectional elevation view of FIG. 3. Pot cores 24 and 26 are formed of a ferromagnetic material, such as ferrite, and contain cylindrical central core sections or legs 28 and 30 ringed by a pair of substantially semicircular legs, such as legs 32 and 34 on the core 24 and legs 36 and 38 on the core 26. Centrally located through the central legs 28 and 30 are axial holes 40 and 42 which are provided by the manufacturer for mounting the cores to any appropriate electronic equipment.

Figure 4:
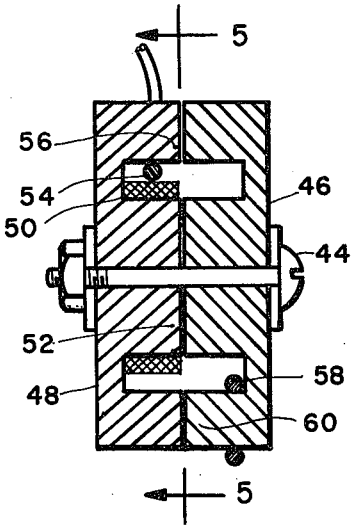
FIG. 4 is a cross-sectional elevation view of the variable ratio transformer of the invention.

The invention uses a pair of substantially identical cores, such as the cores 24 and 26, in a configuration such as illustrated in FIG. 4. In FIG. 4, the two pot cores 24 and 26 are abutted together facing each other as shown and connected together by a suitable machine screw and nut combination 44 so that the pot core 46 and pot core 48 may be rotationally adjusted with respect to each other on an axis common to the central leg of each core. One of the two cores, such as core 48, is provided with a primary winding 50 around the circular central section or leg 52. The core 48 also carries a secondary winding shown in FIG. 4 as a single turn 54 wound on the semicircular leg 56.

The core 46 contains only a short-circuited winding 58 wound on one of its semicircular legs 60.

It will be noted that the sectional elevation view of the two juxtapositioned pot cores 46 and 48 of FIG. 4 bear a close resemblance to the shell transformer configuration of FIG. 1. However, since the pot cores are circular and are rotationally adjustable with respect to each other, the leg 60 with its shorted winding 58 may be positioned against the surface of either leg, or portion thereof, of the core 48 to alter the flux pattern through the core 48 and the amount of flux linking the secondary winding 54.

Figure 5A:
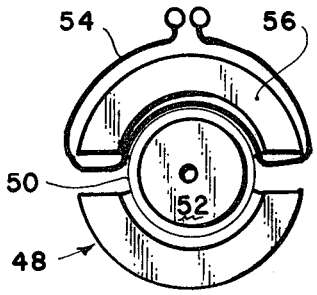
FIGS. 5A–C, 6A–C and 7A–C are schematic diagrams illustrating the respective adjustment positioning of each of the pot cores in the transformer of the invention and the equivalent output obtained therefrom.
Figure 5B:
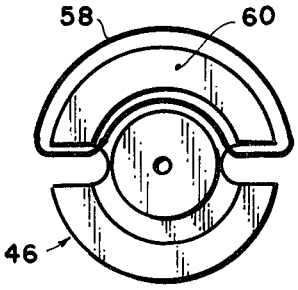
Figure 5C:
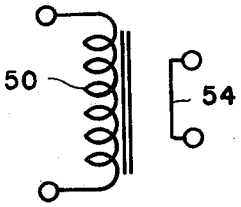

FIG. 5A is an elevation view of the pot core 48 taken along the lines 5—5 of FIG. 4 and illustrates the primary winding 50 wound around the circular central core section 52, and the single turn secondary winding 54 wound around the semicircular leg 56. FIG. 5B is a similar elevation view of the pot core 46 with the shorted turn 58 wound around the leg 60. If the cores 48 and 46 of FIGS. 5A and 5B are positioned together but rotated with respect to each other as shown in FIG. 4, the shorted winding 58 of FIG. 5B will inhibit the flux in the leg 60 as well as the flux through the adjacent leg 56 in the core 48 of FIG. 5A. Consequently, the secondary winding 54 will be linked with negligible flux to produce a substantially zero voltage output as indicated by the transformer schematic diagram of FIG. 5C.

Figure 6A:
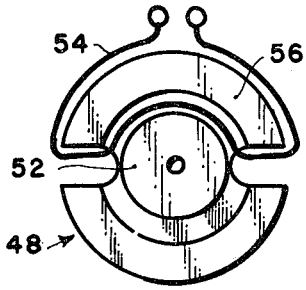
Figure 6B:
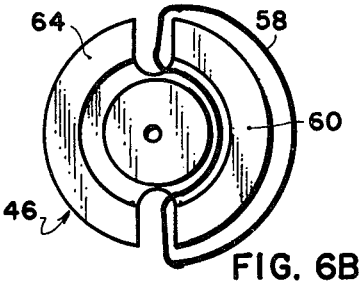
Figure 6C:
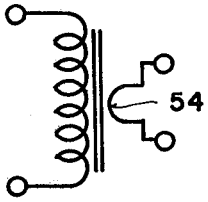

FIG. 6A is another illustration of the pot core 48 but, for the sake of clarity, the primary winding 50 is not shown on the central leg or section 52. If the core 46 is adjusted so that the shorting winding 58 and its respective leg 60 is positioned as shown in FIG. 6B, flux will be inhibited from a portion of the leg 56 of core 48 as well as a corresponding portion of the unwound leg 62 of the core 48. As a result, a portion of the flux generated by the primary winding on the central leg 52 will enter the leg 56 and will link with the secondary winding 54. Therefore, only approximately half of the total available flux will be linked with winding 54 and approximately one-half of the total available output voltage will appear across the secondary winding terminals as illustrated by the schematic diagram of FIG. 6C.

Figure 7A:
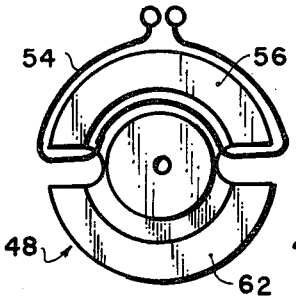
Figure 7B:
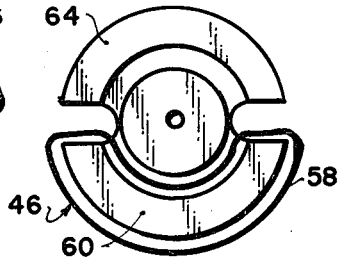
Figure 7C:
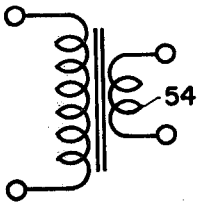

FIG. 7A is another representation of the core 48 of FIGS. 5A and 6A. If the core 46 is positioned with respect to core 48 so that the shorted winding 58 and its leg 60 is positioned as shown in FIG. 7B, then flux is inhibited through the leg 60 as well as the adjacent leg 62 of the core 48. Therefore, since all flux produced in the central core section 52 by the primary winding is shunted through the leg 56 of the core 48, the secondary winding 54 will be linked by the total flux to produce a maximum output as illustrated by the schematic diagram of FIG. 7C. It will be noted that the core alignment of FIGS. 7A and 7B is similar to that illustrated in FIG. 4.

Figure 8A:
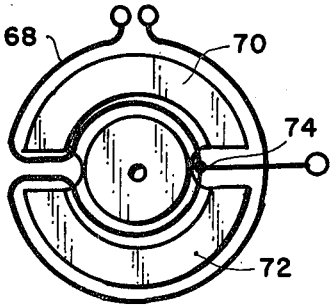
FIGS. 8A and 8B are a schematic diagram illustrating an alternative secondary winding on the pot core of the invention and the equivalent output therefrom.
Figure 8B:
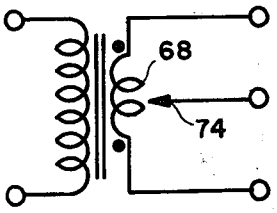

FIG. 8A illustrates an alternate secondary winding for a pot core containing a primary winding (not shown) on the central core section 66. In this configuration the secondary winding 68 is formed in a figure-8 pattern about the semicircular legs 70 and 72 as shown in FIG. 8A. Thus, the portion of the secondary 68 encircling the upper leg 70 is effectively wound counterclockwise whereas the portion around leg 72 is wound clockwise so that equal flux through the legs 70 and 72 would cause canceling voltages to be induced into the respective secondary windings. If the secondary winding 68 is center tapped at the point between the magnetic coupling with legs 70 and 72 as shown by the connection 74, and the terminal therefor considered as a "common" connector, the effect would be a transformer with two oppositely polarized secondary windings. If, however, the core of FIG. 8A is mated together with a core having a shorted secondary winding (such as the previously discussed core 46), the common center tap may be effectively moved by merely adjusting the rotational positioning of the respective pot core pair. By positioning the shorted winding adjacent the core leg 70, all flux would link the secondary associated with the leg 72 to produce an output of a first polarity. Conversely, if the shorted core leg were positioned adjacent the leg 72, all flux would link the secondary winding 68 adjacent the leg 70 to produce a total output of an opposite polarity. Adjustment of the shorted winding leg between legs 70 and 72 will therefore adjust the oppositely opposed voltages as schematically illustrated in the diagram of FIG. 8B.

Figure 9A:
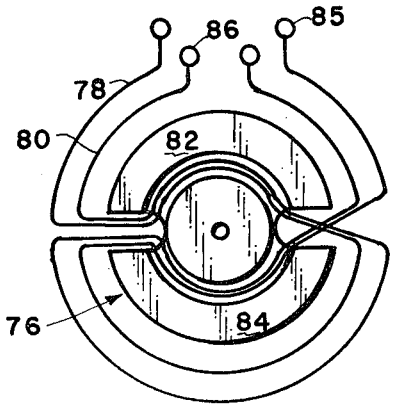
FIGS. 9A and 9B are a schematic diagram illustrating two secondary windings and the equivalent circuit thereof.
Figure 9B:
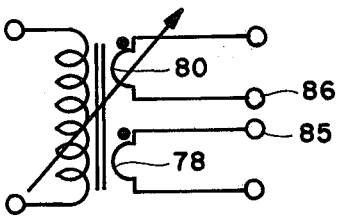

FIG. 9A is still another embodiment in which the pot core 76 contains two parallel secondary windings 78 and 80, each in a figure-8 configuration around the semicircular legs 82 and 84. The secondary winding configuration of FIG. 9A is quite similar to that of FIG. 8A except that there are two windings 78 and 80, neither of which are center tapped. If desired, however, a center tap could be formed by interconnecting the center terminal of each winding, such as the terminal 85 with terminal 86. When the wound core of FIG. 9A is mated with a short-circuited core, such as the previously described core 46, the total transformer may be represented as illustrated in FIG. 9B.

The transformer that includes the pot core 76 of FIG. 9A is particularly useful for adjusting precise output voltages of power supplies, such as the modern switching regulator power supply. Most of these type supplies have multi-tapped outputs for providing various fixed D.C. output levels and only one of these output levels is selected to control the regulation of the primary circuit of the power supply. The D.C. output voltage of this selected output can therefore be held to a very accurate level. However, the remaining output voltages of the power supply are difficult, if not impossible, to accurately control because of the difficulty and expense in producing fractional output windings on the power transformer in which each secondary turn represents as much as two to three volts. If very high output voltage accuracy is required of the supply, then it may be required to carefully select and match the rectifier diodes so that they, together with the output conductors, have a minimum or preselected resistance. The variable ratio transformer of the invention obviates the need for fractional winding transformers and precise diode selection.

Figure 10:
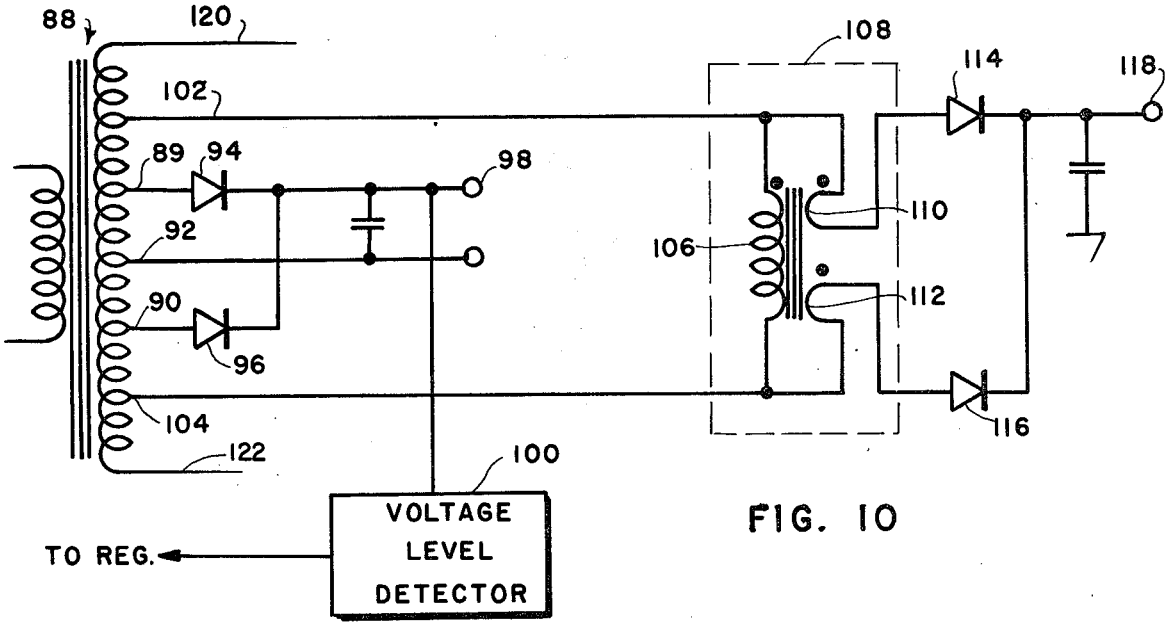
FIG. 10 is a circuit diagram illustrating the use of the dual secondary transformer of FIG. 9 in a typical rectifying circuit of a switching regulator power supply.

The circuitry of FIG. 10 illustrates the use of the variable ratio transformer described in connection with FIG. 9. In FIG. 10, a switching regulator (not shown) supplies a variable high-frequency square wave to the primary winding of the power transformer 88 which has a center tapped secondary and voltage taps that may represent 5 volts, 12 volts, and perhaps 18 volts. The taps 89 and 90 located at 5 volts each side of the center tap 92 are coupled to the anodes of diodes 94 and 96, the cathodes of which are connected together to the output terminal 98. The rectified voltage appearing at output terminal 98 is sampled by a voltage level detector 100 which compares the voltage with an internal standard and transfers the error or difference voltages therefrom back to the switching regulator to vary the switching duty factor. Thus, the regulator can very accurately maintain the voltage level at output terminal 98.

Taps 102 and 104, which are assumed to be located at 12 volts each side of the center tap 92 may actually be located at a few tenths of a volt more or less than the desired 12 volts because of the difficulty in winding a fraction of a secondary turn of transformer 88. Therefore, the taps 102 and 104 are coupled across the primary winding 106 of a variable ratio transformer 108. One terminal of the secondary winding 110 is also coupled to the tap 102 and the oppositely phased terminal of the secondary winding 112 is coupled to the tap 104. The opposite terminal of secondary winding 110 is coupled to the anode of the conventional rectifying diode 114 and the corresponding terminal of the secondary winding 112 is coupled to a conventional rectifier 116. In the usual manner, cathodes of diodes 114 and 116 are coupled together and to the output terminal 118.

In operation, the pot core in the transformer 108 that contains the primary winding 106 and the two secondary windings 110 and 112 is rotatably adjusted against an identical pot core containing only the shorting winding as previously discussed. In such a manner, the voltage level at output terminal 118 may be varied to either increase or decrease the voltage level produced at the taps 102 and 104. It is thereby possible to obtain a very precise D.C. output level irrespective of the inherent inaccuracies in the secondary winding of transformer 88 and resistance variations in the rectifying diodes and their associated conductors.

If it is desired to very closely adjust the D.C. output level from the 18-volt taps 120 and 122 of the transformer 88, it is only necessary to insert into their output circuits a variable ratio transformer similar to the transformer 108 in the 12-volt circuit. Since small voltage adjustments are generally required by transformers used in such a power supply application, the variable ratio transformer may be produced with a primary winding of approximately fifty or sixty turns and a pair of single-turn secondary windings as shown. For other applications it is, of course, necessary to change the turns ratio of the variable turns transformer as required for the particular application.

Having thus described my invention, what is claimed is:

1. A variable ratio transformer for producing a selectably adjustable secondary A.C. output voltage, said transformer comprising:

first and second substantially identical pot cores each having a cylindrical central leg ringed by first and second semicircular legs, said first and second cores being abutted together and adjustably rotatable on a common central axis;

a primary winding on the central leg of said first core;

a secondary winding on at least one of said semicircular legs of said first core; and a short-circuited winding on the first semicircular leg of said second core.

2. The transformer claimed in claim 1 further including connecting means coupled through axial holes in the central legs of said first and second pot cores for maintaining said central legs and said semicircular legs of said first and second cores abutted together, and for permitting relative rotational adjustment between said first and second cores.

3. The transformer claimed in claim 2 wherein said secondary winding is wound around the first semicircular leg of said first core.

4. The transformer claimed in claim 2 wherein said secondary winding is wound on the first and second semicircular legs of said first core.

5. The transformer claimed in claim 4 further including a center tap in said secondary winding at the point in said winding between its magnetic coupling between said first and said second semicircular legs.

6. The transformer claimed in claim 2 further including a plurality of secondary windings on said first core, said plurality being wound in a figure-8 configuration around said first and said second semicircular legs.

7. The transformer claimed in claim 6 wherein each winding in said plurality of windings is electrically insulated from adjacent windings in said plurality.

8. The transformer claimed in claim 7 wherein said plurality of windings are in parallel.

* * * * *